US005432492A

United States Patent [19]

Meershoek

[11] Patent Number: 5,432,492

[45] Date of Patent: Jul. 11, 1995

[54] DEFLECTION YOKE APPARATUS WITH AUXILIAR COILS TO COMPENSENSATE MAGNETIC LEAKAGE

[75] Inventor: Hans Meershoek, Chungli, Taiwan

[73] Assignee: U.S. Philips Corporation, New York, N.Y.

[21] Appl. No.: 212,332

[22] Filed: Mar. 14, 1994

Related U.S. Application Data

[63] Continuation of Ser. No. 964,796, Oct. 22, 1992, abandoned.

[30] Foreign Application Priority Data

Oct. 30, 1991 [EP] European Pat. Off. ..... 91202801

[51] Int. Cl.[6] ..... H01H 1/00; H01J 29/06; H01J 1/52; H01F 13/00

[52] U.S. Cl. ..... 335/214; 315/85; 315/8; 348/820; 361/150

[58] Field of Search ..... 335/213, 210, 214; 313/340, 409, 440, 431; 315/8, 85, 370; 348/820; 361/150

[56] References Cited

U.S. PATENT DOCUMENTS

| | | | |
|---|---|---|---|
| 4,554,488 | 11/1985 | Kobayashi | 315/368 |
| 4,704,564 | 11/1987 | Ito | 315/368 |
| 4,853,588 | 8/1989 | Ohtsu | 313/440 |
| 4,947,083 | 8/1990 | Bosch et al. | 315/8 |
| 5,017,900 | 5/1991 | Ura | 335/210 |
| 5,036,250 | 7/1991 | Sluyterman | 315/8 |
| 5,049,847 | 9/1991 | Okuyama | 335/214 |
| 5,124,613 | 6/1992 | Park | 313/440 |
| 5,138,290 | 8/1992 | Togane | 335/210 |

*Primary Examiner*—Leo P. Picard
*Assistant Examiner*—Stephen T. Ryan
*Attorney, Agent, or Firm*—Robert J. Kraus

[57] ABSTRACT

A deflection yoke apparatus has a pair of horizontal and a pair of vertical deflection coils, a coil separator therebetween, and a funnel-shaped deflection core which provides a magnetic path for magnetic flux generated by the deflection coils. A pair of auxiliary coils are arranged at diametrically opposed positions outside the deflection core, and may be energized by the horizontal deflection current supplied to the horizontal deflection coils. The magnetic field generated by the auxiliary coils at least partially compensates the external magnetic leakage field which is radiated outside the deflection core by the horizontal deflection coils. The auxiliary coils have rod-shaped magnetic cores which are in magnetic flux coupling relationship with the smaller end of the deflection core. Leakage flux compensation is thereby achieved with minimal affect on the deflection fields and with low power dissipation in the auxiliary coils.

9 Claims, 2 Drawing Sheets

DEFLECTION YOKE APPARATUS WITH AUXILIAR COILS TO COMPENSENSATE MAGNETIC LEAKAGE

This is a continuation of prior application Ser. No. 07/964,796, filed on Oct. 22, 1992 is now abandoned.

BACKGROUND OF THE INVENTION

1. Field of the Invention

The invention relates to a deflection yoke apparatus to be mounted on the neck of cathode-ray tube for projecting a raster on a screen of the tube by scanning with at least one electron beam, comprising (a) a pair of horizontal deflection coils for generating a magnetic field to deflect the electron beam in a horizontal direction, (b) a pair of vertical deflection coils for generating a magnetic field to deflect the electron beam in a vertical direction, (c) a coil separator for electrically insulating between the horizontal and vertical deflection coils and having an expanded part at its front end, and (d) a funnel-shaped annular deflection core which forms a magnetic path for magnetic flux generated when deflection current is supplied to the horizontal and vertical deflection coils, the magnetic fields deflecting the electron beam inside said core and producing an external magnetic leakage field outside said core.

2. Description of the Related Art

Recently more stringent standards have been introduced for certain types of picture display devices, notably for monitors, with respect to magnetic leakage fields which they may produce around them. An important source of magnetic leakage fields is the pair of horizontal (or line) deflection coils, which may be operated with deflection currents having frequencies of 15.75 kHz to 120 kHz. It is impossible to design a satisfactorily operating deflection yoke apparatus which does not produce a leakage field. If the leakage field is to be eliminated by means of a protective shield, such a shield would only be effective if the combination of the display tube and deflection unit were also shielded on the display screen side. It is true that the magnetic leakage field of a deflection unit is not very strong; at a distance of 50 cm from the front side of a deflection unit for a 110° monochrome display tube the field strength has already decreased to approximately 1% of the strength of the earth's magnetic field, but it is the variation of the leakage field with respect to time which is important. Field variations may cause electromagnetic interferences in other electronic apparatus which causes these electronic apparatuses to malfunction. Also research is being done to establish whether human health is affected by these leakage fields. The time derivative of the field of the deflection yoke apparatus increases with an increase of the line frequencies, and hence with increasingly shorter fly-back periods.

For compensating the leakage field of the pair of horizontal deflection coils a compensation coil can be used which, when energized, generates a compensating magnetic dipole field. This has been proposed in the published EP-A-220 777. This dipole field can be obtained by energizing an auxiliary coil whose turns have been wound around a bobbin in a square form, which coil has the correct number of turns, the correct surface area and the correct orientation. Energization may be effected, for example, by arranging such coil in series or in parallel with the pair of horizontal deflection coils. The compensation field may be obtained alternatively by energizing two auxiliary coils which are positioned on either side of the deflection yoke apparatus, which auxiliary coils have the correct number of turns, the correct surface area and the correct orientation. Also in this case energization may be effected, for example, by arranging the auxiliary coils in series or in parallel with the pair of horizontal coils.

The auxiliary coils are preferably large so as to reduce their energy content.

However, a problem is that many types of display devices (particularly monitors) lack the space to accommodate large auxiliary coils in their correct position. Consequently, relatively small (too small) auxiliary coils must be used, and so the compensation of the leakage fields consumes much (deflection) energy. Moreover, the sensitivity of the pair of horizontal deflection coils is affected if the known auxiliary coils are arranged in series with them. The induction then increases.

SUMMARY OF THE INVENTION

It is an object of the present invention to provide measures enabling a compensation of the magnetic leakage field which causes less energy loss and less affect on deflection sensitivity than the known measures.

According to the invention this object is solved in that the deflection yoke apparatus of the type described in the opening paragraph has (e) two auxiliary coils which are arranged at diametrically opposed positions in the vertical direction outside the deflection core to generate a magnetic field with a direction opposed to the direction of said external magnetic leakage field when a horizontal deflection current is supplied to said coils, each auxiliary coil having a magnetic rod of soft magnetic material as a magnetic core for said coil, and (f) means for engaging the magnetic rods of the two auxiliary coils in magnetic flux coupling relationship with the smaller end of the funnels deflection core.

The effectiveness of this inventive solution for leakage field compensation, based on the use of rod-shaped auxiliary core means of a magnetizable material provided with (toroidal) auxiliary coils, is superior to solutions which are based on the use of coreless, i.e. air-cored, auxiliary coils and also to solutions which are based on the use of auxiliary coils wound on magnetic rods which do not engage the smaller end of the deflection core in a magnetic flux coupling relationship.

In practice the inventive solution was found to compensate the leakage fields effectively, and with a reduced loss of deflection sensitivity. In a given case, for example, such reduction was by a factor 5 as compared with conventional auxiliary coils.

Since the magnetic rods of the two auxiliary coils of the inventive solution are arranged in magnetic flux-coupling relationship with the smaller end of the deflection core, the assembly of deflection core and magnetic rods acts, as it were, like one magnetic core of minimum length.

An engaging means is provided for engaging the magnetic rods of the auxiliary coil means in the required magnetic flux-coupling relationship with the deflection core.

A preferred embodiment of the invention is characterized in that said engaging means comprises an annular member through which the deflection core passes, which annular member has two support members which support the magnetic rods in inclined positions towards the smaller diameter end of the deflection core, and connection pans which connect the annular member to the expanded pan of the coil separator.

This construction provides a stable and simple support for supporting the magnetic rods of the auxiliary coils in a desired angled relationship with the smaller diameter end of the deflection core.

The stability may be improved by bonding the end faces of the magnetic rods to the deflection core.

The simplicity may be improved by using connection pans in the form of click-on mounts.

BRIEF DESCRIPTION OF THE DRAWINGS

These and other embodiments will be described with reference to the wherein.

DESCRIPTION OF THE PREFERRED EMBODIMENTS

Figure 1:
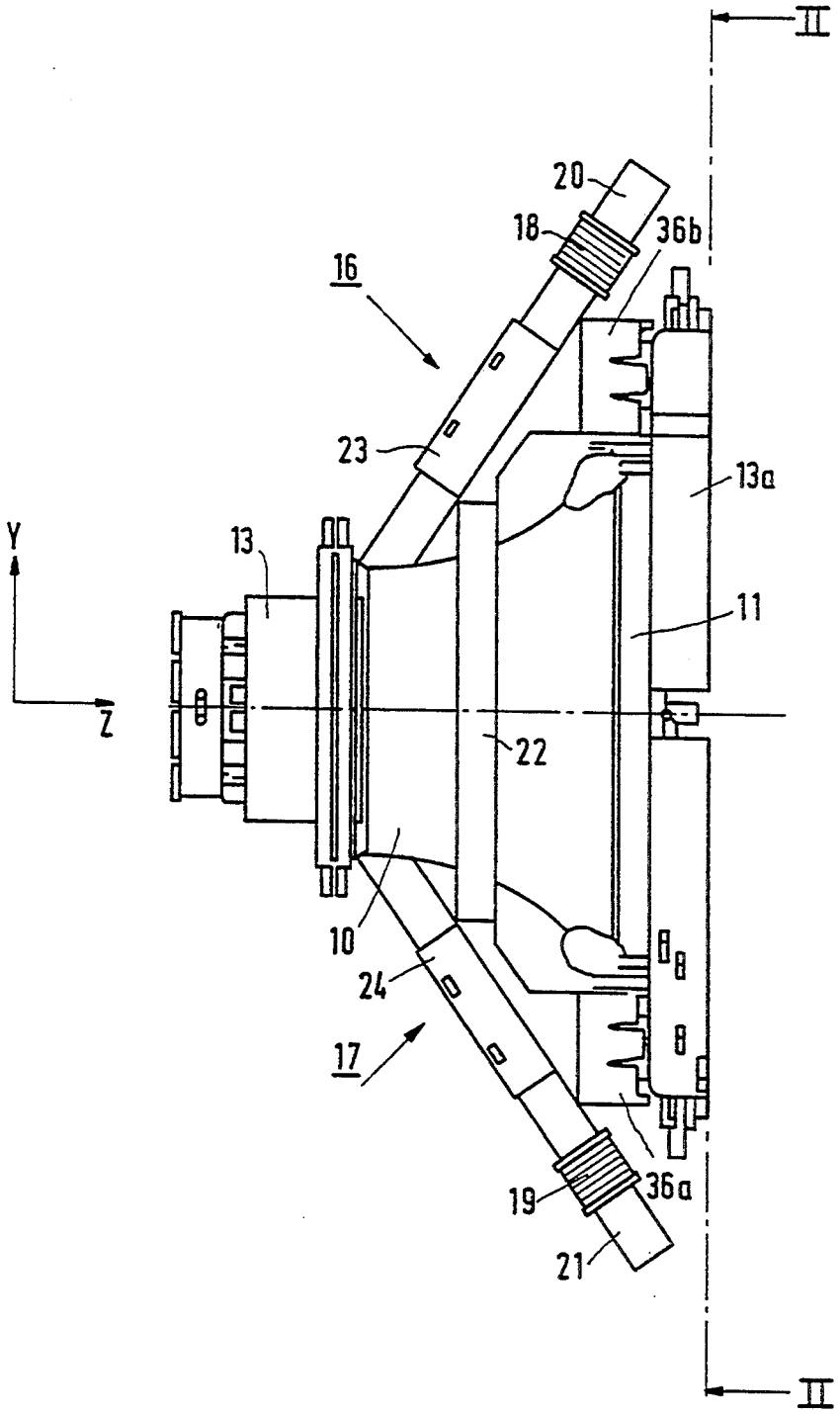
FIG. 1 is a side view of deflection yoke apparatus provided with auxiliary coils in accordance with the present invention.
Figure 2:
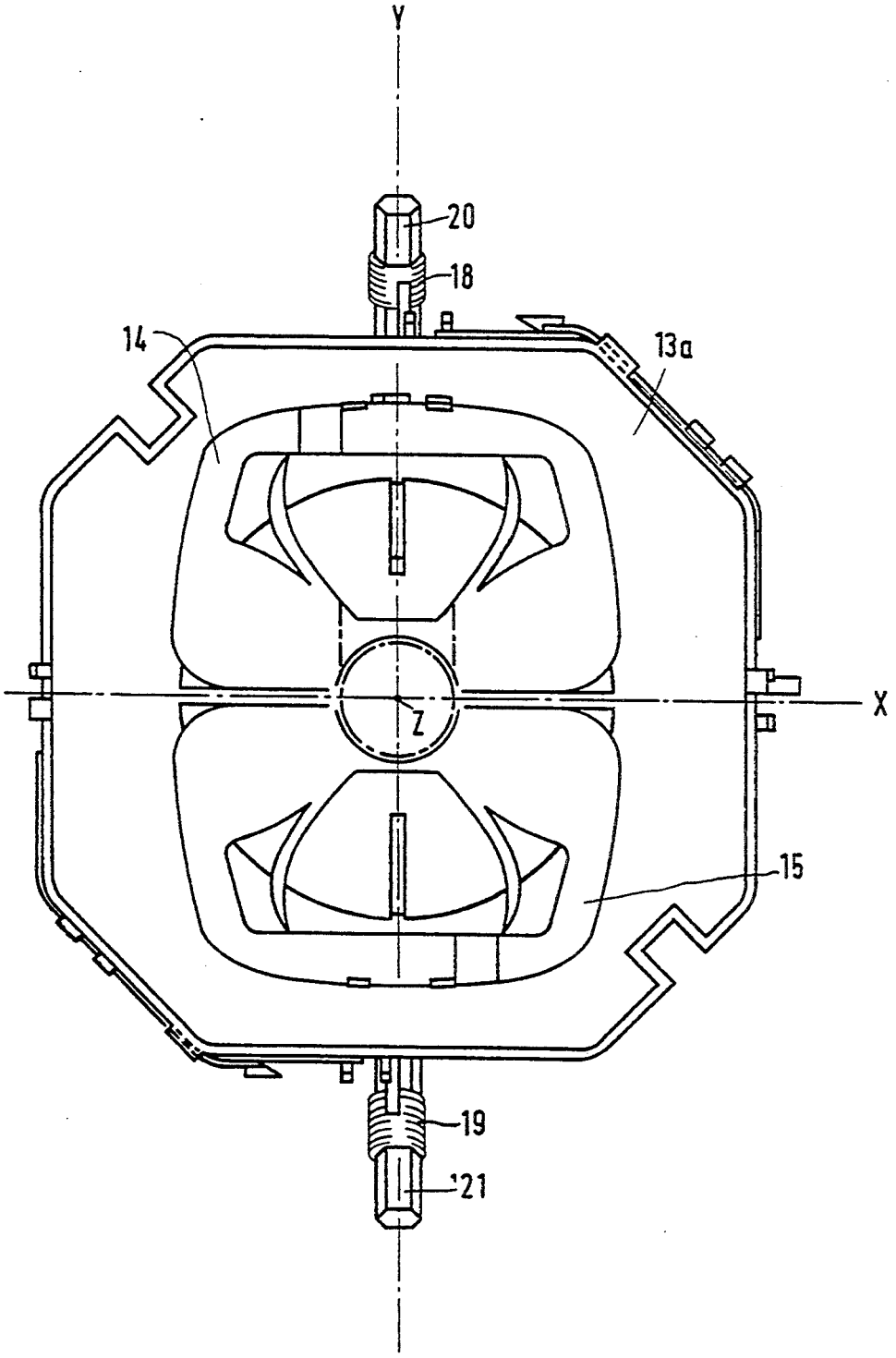
FIG. 2 is a front view of the apparatus in FIG. 1.

In the side now in FIG. 1 an annular ferrite core 10 is supported on a coil separator 13 made of plastic resin material around which a pair of vertical deflection coils are arranged. Only one of the vertical deflection coils, coil 11, is visible in FIG. 1, the other being in diametrically opposing position on the opposite side of the apparatus. Inside the coil separator 13 a pair of horizontal deflection coils 14 and 15 is arranged as shown in FIG.2. On the exterior of the deflection core 10, auxiliary coil devices 16 and 17 are arranged at a slanting angle in the vertical plane and engage the smaller diameter end of the core 10.

FIG. 2 shows a front view of the apparatus in FIG. 1 and, the deflection core 10 being located at the coordinate position where it is divided into four equal portions by X and Y axes. As viewed on this coordinate system, a pair of horizontal deflection coils 14 and 15 are respectively arranged at upper and lower sides in reference to the X axis and symmetrically in reference to the Y axis. The auxiliary coil devices are located at positons in the Y-axis direction equally distant from the X axis and parallel to the Y-Z plane.

An essential aspect of the invention is the relationship between the deflection core 10, in the interior of which the pair of vertical deflection coils and the pair of and horizontal deflection coils 14, 15 are disposed, and the auxiliary coil devices 16 and 17. Auxiliary coils 18 and 19 are wound on magnetic rods 20 and 21 with high magnetic permeability, such as ferrite, permalloy, silicon steel sheet or other such material, the lengths of which rods are almost equal to the length of the deflection core 10 in the axial direction of the core so as to intensify the magnitude of the magnetic field generated when a current is supplied to the auxiliary coils. Auxiliary coils 18 and 19 may be produced by winding several turns of 0.4 mm diameter copper wires which are stranded or bound, and may be connected in series with the horizontal deflection coils 14 and 15. Accordingly, the current flowing through the horizontal deflection coils is also supplied to auxiliary coils 18 and 19.

In one embodiment the magnetic rods 20, 21 had a length of 60 mm and a diameter of 5 mm, and were made of 4C6 ferrite. Rod lengths of, for example, between 5 and 10 cm were found to be suitable in practice. Around the rods 20, 21 auxiliary coils 18, 19 are wound having a limited number of turns (in order to minimize the affect on the inductance of the deflection coils).

In order to enable the magnetic rods 20, 21 to engage the smaller diameter end of the deflection core 10 in flux-coupling relationship, the vertical deflection coils are of the saddle type: they are arranged inside the deflection core 10 and do not extend along the outer surface thereof.

For stable positioning, the rods 20, 21 preferably are bonded to the core 10 by means of an adhesive.

The rods 20, 21 are supported by an annular member 22 which is provided with connecting parts 36*a*, 36*b*. . . which connect the annular member 22 to the front expanded part 13*a* of the coil separator 13. Preferably the connections are of the click-on type.

The annular member 22, through which the core 10 passes, is also provided with support members 23, 24 through which pass the magnetic rods 20, 21.

The size of the magnetic rods is determined according to the design of each type of the deflection yoke apparatus. The external sizes of auxiliary coils 18 and 19, the number of turns of said coils, the diameters of the conductors used therein, etc. are determined taking into account the impedance of the horizontal deflection coils, the magnitude of the external leakage magnetic field, the frequency of the current flowing through said coils 18 and 19, etc.

As described above, the deflection yoke apparatus in accordance with the present invention can reduce the external leakage magnetic field radiated from the deflection coils, which is, an unwanted radiation and minimize electromagnetic interference to other electronic equipment. Such apparatus of can be modified in design within the range of the above-mentioned objects.

I claim:

1. A deflection yoke apparatus for a cathode ray display tube having a screen-supporting portion, a neck portion within which at least one electron beam is produced, and an intermediate portion onto which the apparatus is to be mounted, said apparatus comprising:

a. deflection means comprising:

i. a pair of horizontal deflection coils for producing a first magnetic field for deflecting the at least one electron beam in a horizontal direction;

ii. a pair of vertical deflection coils for producing a second magnetic field for deflecting the at least one electron beam in a vertical direction; and iii. an electrically insulating coil separator disposed between said pairs of deflection coils;

b. a funnel-shaped deflection core of magnetically-permeable material having a central longitudinal axis and being arranged proximately around the deflection means for providing a path for flux in the first and second magnetic fields, said magnetic fields also including flux inside the deflection core for effecting the deflection of the at least one electron beam and including leakage flux outside the deflection core; and c. magnetic-field-influencing means comprising:

i. a pair of diametrically-opposed rods of magnetically-permeable material having respective central longitudinal axes lying substantially in a vertical plane which substantially bisects the deflection core, each of said rods being disposed outside of said core, extending along substantially the entire axial length of said deflection core, and having a first end magnetically coupled through a closed magnetic path to a smaller end of said deflection core; and ii. a pair of auxiliary coils, each disposed about a respective one of the diametrically-opposed rods such that said coil is wound around the respective central longitudinal axis of said rod;

said magnetic-field-influencing means, upon the supply of a horizontal deflection current to the auxiliary coils, producing a magnetic field for opposing at least a portion of the leakage flux of the first magnetic field.

2. A deflection yoke apparatus for a cathode ray display tube having a screen-supporting portion, a neck portion within which at least one electron beam is produced, and an intermediate portion onto which the apparatus is to be mounted, said apparatus comprising:

a. deflection means comprising:

i. a pair of horizontal deflection coils for producing a first magnetic field for deflecting the at least one electron beam in a horizontal direction;

ii. a pair of vertical deflection coils for producing a second magnetic field for deflecting the at least one electron beam in a vertical direction; and iii. an electrically insulating coil separator disposed between said pairs of deflection coils;

b. a funnel-shaped deflection core of magnetically-permeable material having a central longitudinal axis and being arranged around the deflection means for providing a path for flux in the first and second magnetic fields, said magnetic fields also including flux inside the deflection core for effecting the deflection of the at least one electron beam and including leakage flux outside the deflection core; and c. magnetic-field-influencing means comprising:

i. a pair of diametrically-opposed rods of magnetically-permeable material having respective central longitudinal axes, each of said rods being vertically arranged outside of said core at an angle with respect to said axis, extending along a substantial axial length of said deflection core, and having a first end proximate to and closely magnetically coupled to a smaller end of said deflection core; and ii. a pair of auxiliary coils, each disposed about a respective one of the diametrically-opposed rods such that said coil is wound around the respective central longitudinal axis of said rod;

said magnetic-field-influencing means, upon the supply of a horizontal deflection current to the auxiliary coils, producing a magnetic field for opposing at least a portion of the leakage flux of the first magnetic field.

3. An apparatus as in claim 1 or 2 including engaging means for supporting the rods such that the first end of each of said rods contacts the smaller end of the deflection core.

4. An apparatus as in claim 3 where the engaging means comprises an annular member surrounding the deflection core and means for supporting each of the rods at an inclination relative to the longitudinal axis of said core.

5. An apparatus as in claim 4 where the engaging means further comprises connection means for attaching said engaging means to the coil separator.

6. An apparatus as in claim 1 or 2 where at least the vertical deflection coils are of the saddle type.

7. A deflection yoke apparatus for a cathode ray display tube having a screen-supporting portion, a neck portion within which at least one electron beam is produced, and an intermediate portion onto which the apparatus is to be mounted, said apparatus comprising:

a. deflection means comprising:

i. a pair of horizontal deflection coils for producing a first magnetic field for deflecting the at least one electron beam in a horizontal direction;

ii. a pair of vertical deflection coils for producing a second magnetic field for deflecting the at least one electron beam in a vertical direction; and iii. an electrically insulating coil separator disposed between said pairs of deflection coils;

b. a deflection core of magnetically-permeable material having a central longitudinal axis, having first and second ends which are, respectively, closer to and further from the neck portion, and being arranged around the deflection means for providing a path for flux in the first and second magnetic fields, said magnetic fields also including flux inside the deflection core for effecting the deflection of the at least one electron beam and including leakage flux outside the deflection core; and c. magnetic-field-influencing means comprising:

i. first and second elongated rods of magnetically-permeable material disposed, respectively, above and below the deflection core, said rods having respective central longitudinal axes, extending along substantially the entire axial length of said deflection core, and each having a first end magnetically coupled through a closed magnetic path to the first end of said deflection core; and ii. a pair of auxiliary coils, each disposed about a respective one of the rods such that said coil is wound around the respective central longitudinal axis of said rod;

said magnetic-field-influencing means, upon the supply of a horizontal deflection current to the auxiliary coils, producing a magnetic field for opposing at least a portion of the leakage flux of the first magnetic field.

8. An apparatus as in claim 1, 2, or 7 where the rods diverge from each other with distance from the respective first ends of said rods.

9. An apparatus as in claim 1, 2 or 7 where each of the auxiliary coils is wound around a central axis which is substantially coincident with the central longitudinal axis of the respective rod around which said coil is disposed.

* * * * *